US007690226B2

(12) United States Patent
Son et al.

(10) Patent No.: US 7,690,226 B2
(45) **Date of Patent: *Apr. 6, 2010**

(54) WASHING MACHINE AND METHOD FOR MANUFACTURING DOOR THEREOF

(75) Inventors: Ji Chang Son, Changwon-si (KR); Hye Yong Park, Changwon-si (KR); Young Hoon Ha, Busan-si (KR); Bo Yeon Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 781 days.

This patent is subject to a terminal disclaimer.

(21) Appl. No.: 11/448,982

(22) Filed: Jun. 8, 2006

(65) Prior Publication Data

US 2007/0017258 A1 Jan. 25, 2007

(30) Foreign Application Priority Data

Jun. 9, 2005 (KR) ..... 10-2005-0049489
Jun. 9, 2005 (KR) ..... 10-2005-0049490

(51) Int. Cl.
*D06F 37/28* (2006.01)

(52) U.S. Cl. ..... 68/3 R; 68/196

(58) Field of Classification Search ..... 68/24, 68/196, 3 R

See application file for complete search history.

(56) References Cited

U.S. PATENT DOCUMENTS 2,200,144 A * 5/1940 Zimarik ..... 68/58
2,313,152 A * 3/1943 Jorgenson ..... 68/144
2,317,213 A * 4/1943 Oliver ..... 220/849
3,811,300 A * 5/1974 Barton et al. ..... 68/12.19
4,225,377 A * 9/1980 Bachtiger ..... 156/314
4,564,557 A * 1/1986 Ohgushi et al. ..... 428/333
6,074,741 A * 6/2000 Murata et al. ..... 428/327
2003/0196460 A1* 10/2003 Lyu et al. ..... 68/13 R
2005/0138974 A1* 6/2005 Ha et al. ..... 68/23 R
2006/0117809 A1* 6/2006 Ha et al. ..... 68/3 R
2006/0117813 A1* 6/2006 Ha et al. ..... 68/196

FOREIGN PATENT DOCUMENTS

DE 43 27 916 2/1994
JP 04224945 A * 8/1992
KR 10-0465148 B1 12/2004
KR 10-0465149 B1 12/2004
KR 10-0479105 B1 3/2005
KR 10-0483664 B1 4/2005
WO WO 2005/014913 2/2005

* cited by examiner

*Primary Examiner*—Joseph L Perrin
(74) *Attorney, Agent, or Firm*—KED & Associates, LLP

(57) ABSTRACT

A washing machine and a method of manufacturing a door thereof are provided. The washing machine may include a door rotatably coupled to a cabinet, and a door ring positioned on the cabinet at an external circumference of the door to reinforce a rigidity of the cabinet and to improve an external appearance of the washing machine.

23 Claims, 19 Drawing Sheets

WASHING MACHINE AND METHOD FOR MANUFACTURING DOOR THEREOF

BACKGROUND OF THE INVENTION

1. Field of the Invention

The present invention relates to a washing machine, especially, to a washing machine and method for manufacturing door thereof reinforcing the rigidity of a cabinet as well as improving a fine view around a door as installing a door ring on a cabinet around a door, and preventing the glaring as well as improving a fine view of a door as forming a decoration part which is continued by reflection/irreflection or intaglio/relief patterns on the front surface of a door.

2. Description of the Conventional Art

Generally, a washing machine is a machine which removes dirt, etc. stuck on the clothes as providing a mechanical action as using electricity; a drum washing machine has effects which hardly damage the laundry, the laundry does not get tangled, and a strike and rub washing effect.

FIG. 1 is a perspective view that a drum washing machine is illustrated in accordance with the conventional technique, FIG. 2 is a side cross-sectional view that a drum washing machine is illustrated in accordance with the conventional technique, and FIG. 3 is a plane cross-sectional view according to the A-A line of FIG. 2.

As illustrated on the FIGS. 1 and 2, a conventional drum washing machine is composed as including: a cabinet (2), forming the external aspect of a washing machine; a tub (4) installed to be hung by a spring (3) in the inside of a cabinet (2); a drum (5) installed on the inner aspect of the tub (4) and the laundry is washed; a lift (6) installed on the inner aspect of a drum (4) and drags the laundry up to be fell on a certain height by gravity; a motor (7) which is installed on the rear part of the tub (4) and occur a power; a cabinet cover (17) installed on the front and a laundry entrance (18) capable of inputting and taking out of the laundry is formed on the center; a door (20) as installed on the cabinet cover (17) capable of opening and closing the laundry entrance, preventing the laundry breaking out of the laundry entrance.

Between a tub (4) and a door (20), a gasket (8) which is moderating the impulse from the rotation of a drum (5) as well as being a packer preventing the washing water flooding to outside is installed.

And, a top plate (9) and a base (10) which are formed of a superior surface and a inferior surface are installed on the upper part and lower part of the above-mentioned washing machine; a draining pump (11) and a draining hose (12) which drain or circulate the washing water are installed on the lower part of a tub (4); a water supply hose (13), a water supply valve (14), and a detergent box (15) which supply the washing water and the detergent into the inner part of a tub (4) are inner packed on the lower side of a top plate (9).

Also, a door (20) of a drum washing machine in accordance with the conventional technique is composed as including: a ring-shaped door frame which is installed to be possible to be rotated; a door hinge (24) that each of either ends are installed on a door frame (21) and a cabinet cover (17), and supporting a door frame to be rotated; a door glass (25) installed on the opened center hole (21*a*) of a door frame(21) so as to look at the inner situation of a drum (5).

A door frame (21), generally, is an injection of a plastic quality, and composed of: a front door frame (22) placed on the front and has a handle (29) on an aspect; a rear door frame (23) installed on the rear surface of a front door fame (22), one of the ends of the door hinge (24) is placed. A hook is formed protruded on an aspect on a rear door frame (23), a hook hole (28) to be united with a hook (27) is formed on a cabinet cover (17).

On a door glass (25), an edge part is fixed between a front door frame (22) and a rear door frame (23), so a center hole (21*a*) of a door frame (21) is installed to be closed.

On the other hand, recently, as the design has become an important element deciding the marketability of a product besides the performance and endurance; developing a new model as giving a suitable specific gravity for contour, colors, and texture when developing a new product so as to satisfy the consumer's aesthetical desire has been becoming a trend.

However, a drum washing machine in accordance with a conventional technique, a door frame (21) is an injection of plastic quality, so it becomes an occasion declining the marketability of a product as unable to give the consumers an impression of high classic on a fine view.

Also, recently, gradually being large-sized of the drum washing machines has been becoming a trend, the above-mentioned laundry entrance (18) and a door (20) become large-sized. Accordingly, a door frame (21) has to be formed with an enough strength to support the load of an enlarged door glass (2), but because a door frame (21) is an injection molded with a plastic quality, the insurance of the strength isn't easy.

To improve the above-mentioned problems; forming a door frame (21) with a metallic texture which is capable of creating a high classic image and has an excellent strength is possible; but in this case, the material cost is increased, the total weight of a door is increased, and the surface processing to improve the texture is difficult.

Especially, a door (20) is installed on a cabinet cover (17) which is composing a cabinet (2) so as to be opened and closed; because any particular intermediate member isn't installed around a laundry entrance (18) on a cabinet cover (17), the insurance of the enough strength to support the gradually enlarged doors is difficult.

Also, because the front surface of a cabinet cover (17) is usually formed as a single plane structure, there is a limit on improving the whole of front external aspect of a washing machine.

SUMMARY OF THE INVENTION

Therefore, an object of the present invention is to solve the problems of the conventional technique and providing a washing machine which is improving the strength of the structures around a door and the external fine view as installing a ring around a door.

Another object of the present invention is to provide a manufacturing method of washing machine and a washing machine door capable of intermediating the strength of a door frame, and exchanged just a front element easily according to the needs as installing a front element on a door frame of a door.

Another object of the present invention is to provide a manufacturing method of washing machine and a washing machine door capable of improving the entire sense of beauty as well as preventing the glaring as forming a decoration part which is continued by reflection/irreflection or intaglio/relief patterns on the front surface of a door frame or a front element of a door.

To achieve these and other advantages in accordance with the purpose of the present invention, as embodied and broadly described herein, there is a washing machine comprising: a door rotatably installed on a cabinet, and open and close a laundry entrance; a door ring placed on a cabinet to be belted on the circumference of the external aspect of a door.

A door ring is formed as more bulgily protruded than other parts of a cabinet, and a door ring is united with a hook or a adhesion element on a cabinet, or formed to be one as bended on a cabinet and a gliding layer is formed on the external surface.

Also, a front element that the strength is excellent and the external aspect is fine is installed on the front surface of a door, and a front element has a decoration part that reflection and irreflection patterns are repeatedly formed as intaglio and relief form. A decoration part that reflected and irreflection patterns are formed as intaglio and relief form by an etching method; at least one of the reflection and irreflection patterns is being formed as a lattice shape, round shape, quadrilateral shape , or a trilateral shape.

Or differently with the above-mentioned, a decoration part that the intaglio and relief patterns are formed repeatedly on the front surface of a door ; at least, metal gliding layer is formed on the front surface of a door.

Or differently with the above-mentioned, a decoration part that the reflection and irreflection patterns are formed repeatedly on the front surface of a door; a metal gliding layer is formed on the front surface of a door; a decoration part is formed on the metal gliding layer; a protection film which of transparent material is worn on the surface of a metal gliding layer.

A decoration part that reflection and irreflection patterns are formed as intaglio and relief forms; at least one of the reflection and irreflection patterns is being formed as a lattice shape, round shape, quadrilateral shape , or a trilateral shape.

On the other hand, a manufacturing method of a door of a washing machine comprising; a cutting step which is cutting out a front element from a metal plate body; a material feel forming step which is forming a decoration part on a front element; and on forming a material feel forming step, the reflection and irreflection patterns are arranged repeatedly.

The decoration patterns on a material feel forming step are composed of the forms of intaglio and relief.

DETAILED DESCRIPTION OF THE EMBODIMENTS

Reference will now be made in detail to the preferred embodiments of the present invention, examples of which are illustrated in the accompanying drawings.

Hereinafter, preferred embodiments of a washing machine and the manufacturing method according to the present invention will be explained.

Figure 1:
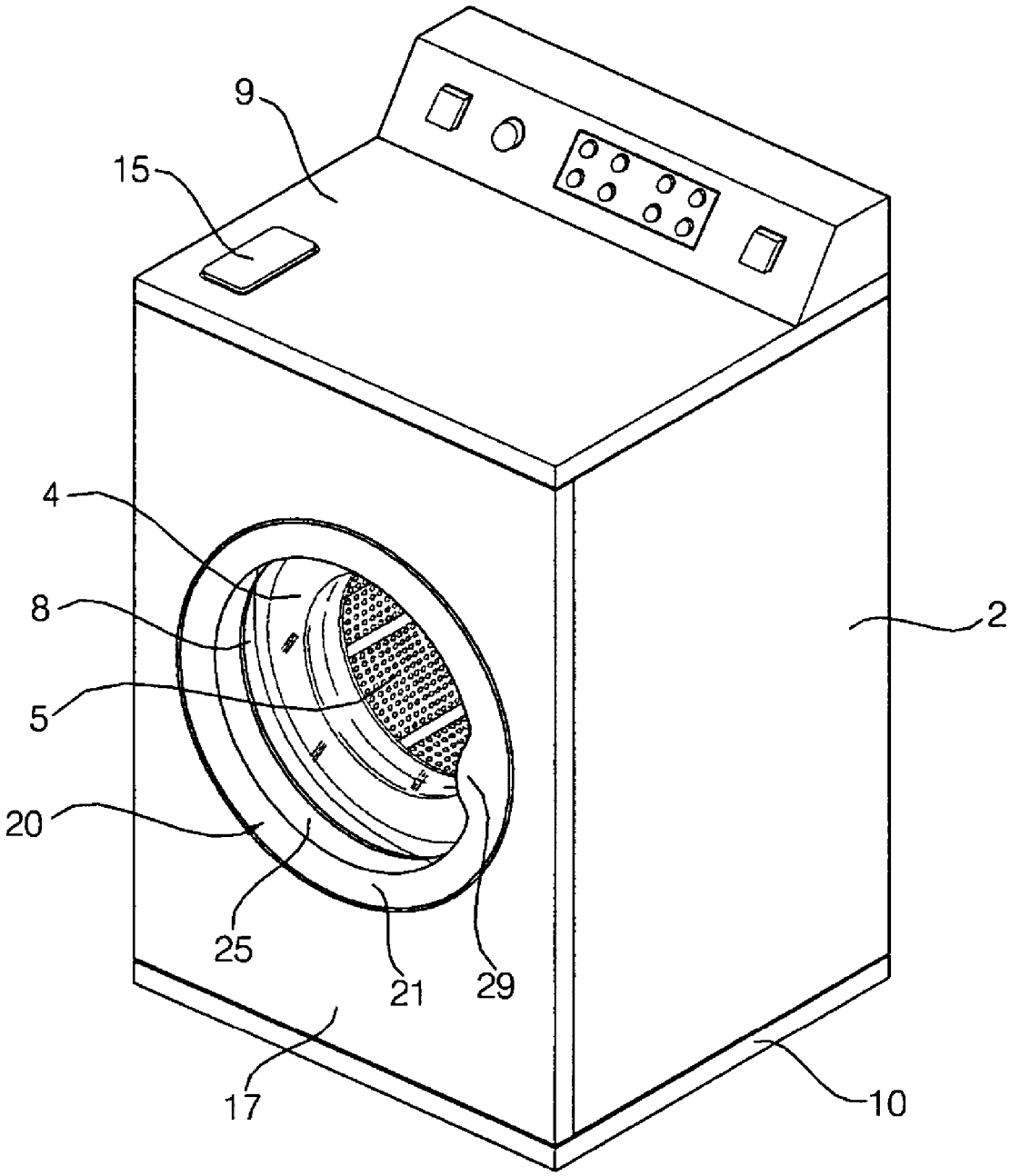
Fig.1 (related art)
FIG. 1 is a perspective view illustrating a drum washing machine in accordance with the conventional technique.
Figure 2:
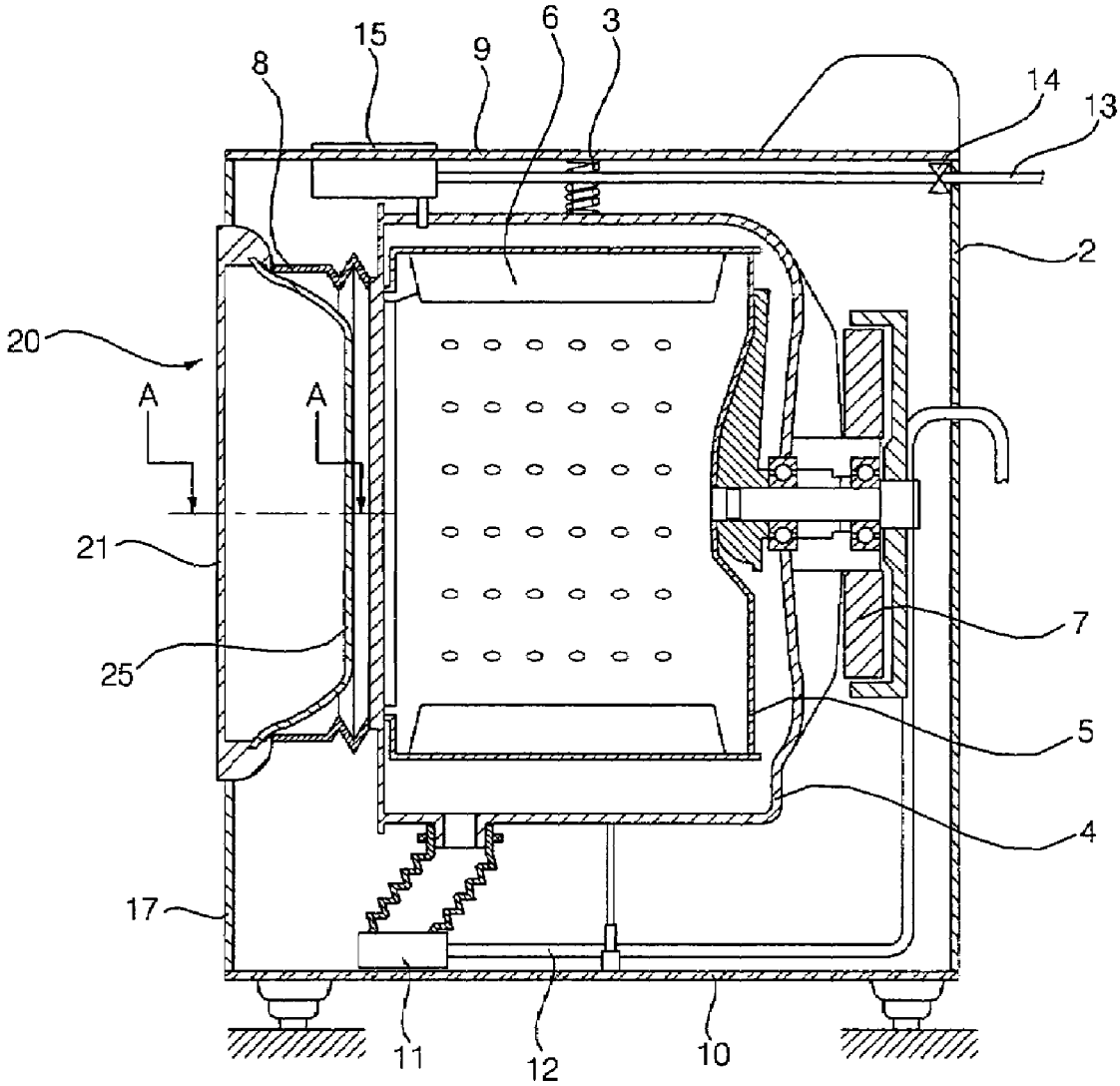
Fig.2 (related art)
FIG. 2 is an aspect cross-sectional view illustrating a drum washing machine in accordance with the conventional technique.
Figure 3:
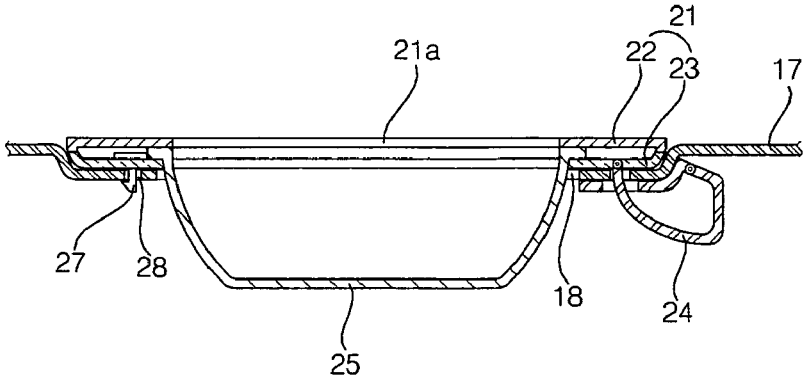
Fig.3 (related art)
FIG. 3 is a plane cross-sectional view cording to the line A-A of FIG. 2.
Figure 4:
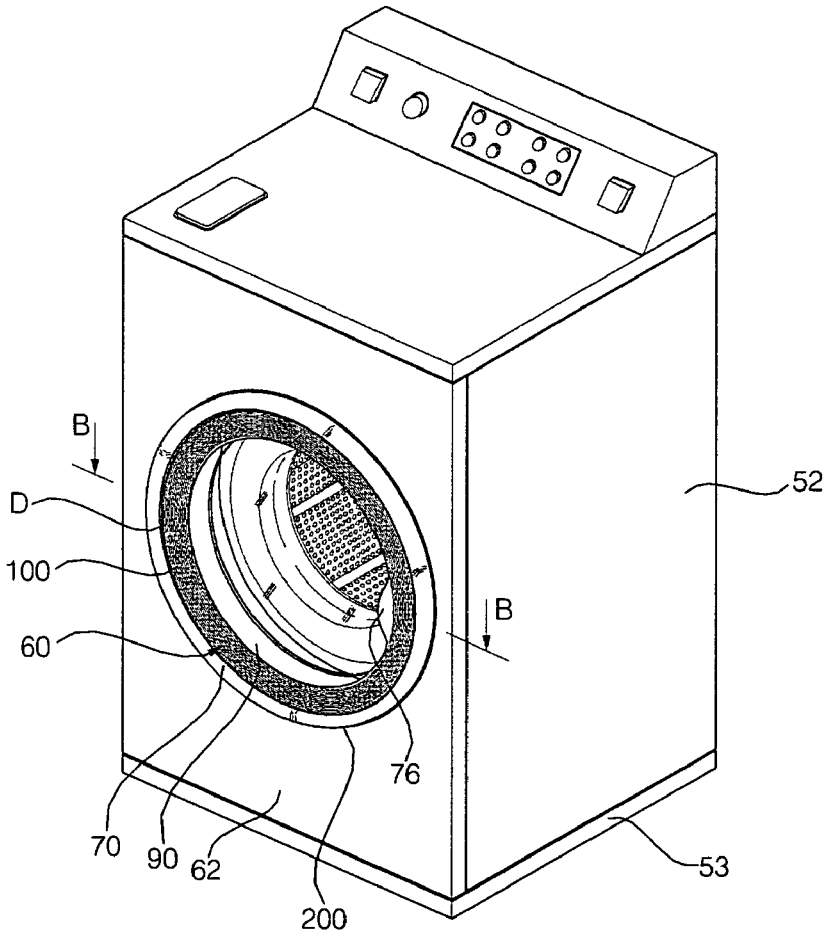
FIG. 4 is a perspective view illustrating a drum washing machine having a door ring according to the preferred embodiment No. 1 of the present invention.
Figure 5:
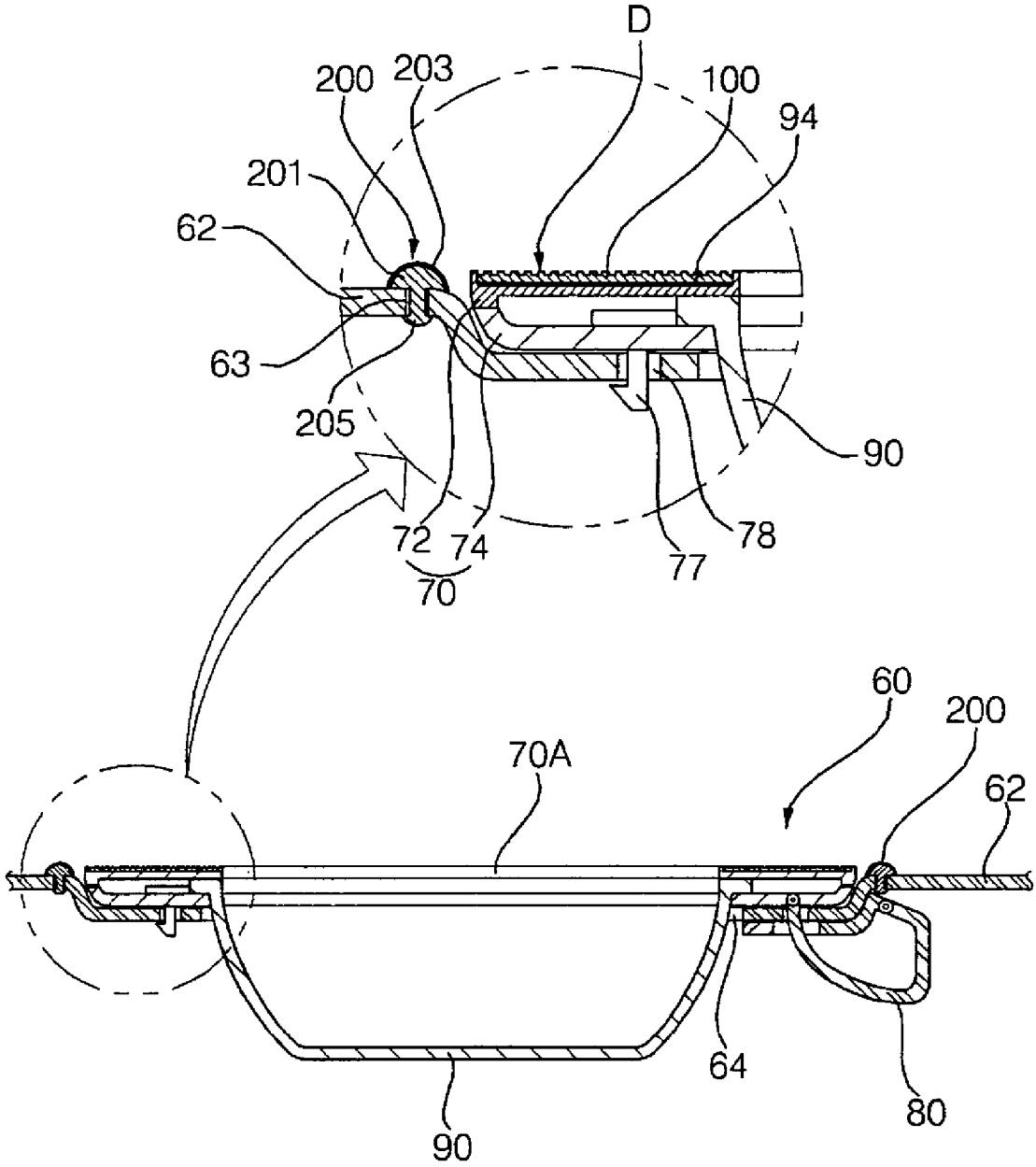
FIG. 5 is a plane cross-sectional view according to the line B-B direction of FIG. 4.
Figure 6:
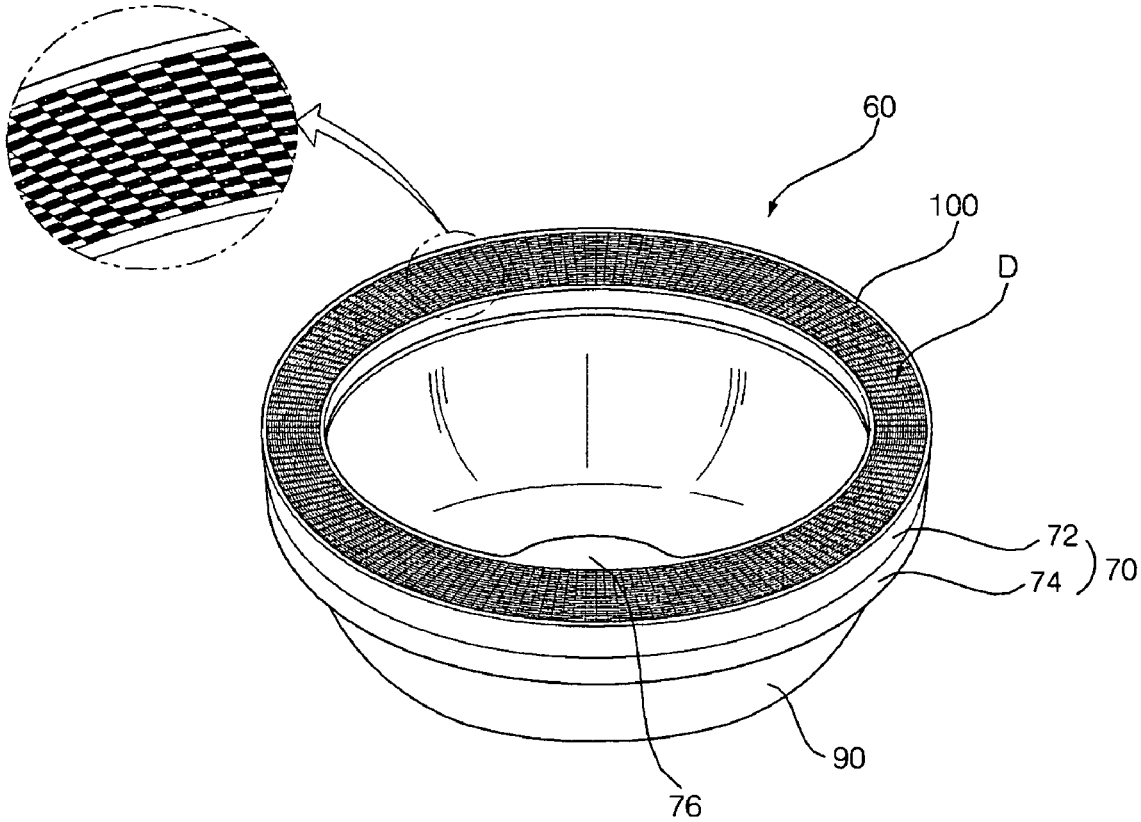
FIG. 6 is a perspective view illustrating a door of a drum washing machine according to the preferred embodiment No. 1 of the present invention.
Figure 7:
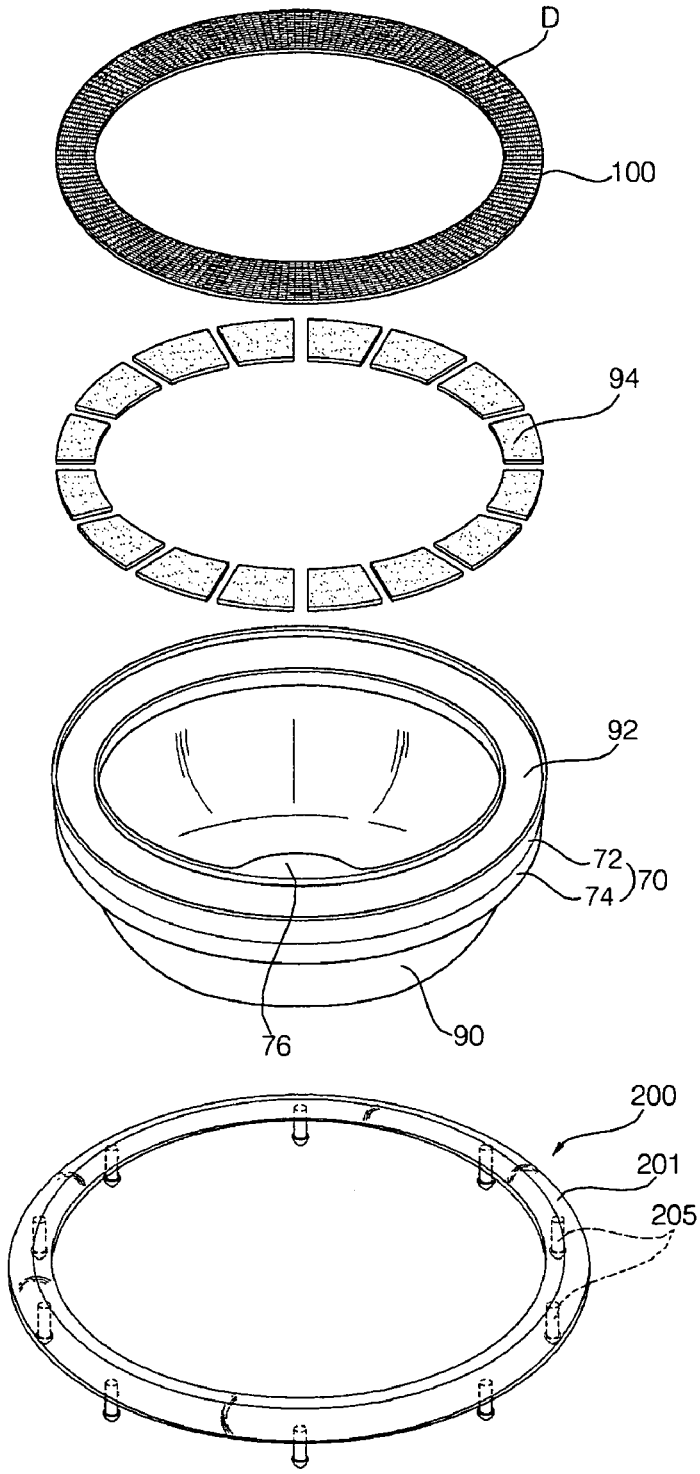
FIG. 7 is a disassembled perspective view illustrating a door and a door ring of a drum washing machine according to the preferred embodiment No. 1 of the present invention.

FIG. 4 is a perspective view illustrating a drum washing machine having a door ring according to the preferred embodiment No. 1 of the present invention; FIG. 5 is a plane cross-sectional view according to the line B-B direction of FIG. 4; FIG. 6 is a perspective view illustrating a door of a drum washing machine according to the preferred embodiment No. 1 of the present invention; FIG. 7 is a disassembled perspective view illustrating a door and a door ring of a drum washing machine according to the preferred embodiment No. 1 of the present invention;

As illustrated on FIG. 4 to 7, a drum washing machine according to the preferred embodiment is composed as including: a ring-shaped door frame (70) which is installed to be rotated on a cabinet cover (62) that a laundry entrance (64) is formed; a door hinge (80) that each of either ends are installed on a door frame (70) and a cabinet cover (62), and supporting a door frame (70) to be rotated; a door glass (90) installed on the opened center hole (70A) of a door frame (70) so as to look at the inner situation of a drum; a front element (100) installed on the front surface of a door frame (70), and have a seat structure to intermediate the strength of a door (60).

A door frame (70) is composed of: a front door frame (72) placed on the front and has a handle (76) on an aspect; a rear door frame (74) installed on the rear surface of a front door fame (72), one of the ends of the door hinge (80) is placed.

A hook (77) is formed protruded on an aspect on the rear surface of a rear door frame (74); a hook hole (78) to be united with a hook (77) is formed on a cabinet cover (62); a door (60) is fixed on the state that a laundry entrance (64) is closed as a hook (77) is fixed as being inserted on a hook hole (78).

It is accurate that a front door frame (72) and a rear door frame (74) are formed with the plastic texture which is light and the injection performance is excellent.

On a glass (90), an edge part is placed between a front door frame (72) and a rear door frame (74), and an opened center hole (70A) of a door frame (70) is closed according to a front door frame (72) is united with a rear door frame (74).

On the other hand, a decoration part (D) is formed to give the front a high-classic textured sense on a front element; on this preferred embodiment, a decoration part (D) is formed as a lattice patterned as illustrated on FIG. 5 to 6. A front element (100) is installed as inserted on a install groove (92) which is formed on the front part of a door frame (70).

A install groove (92) is formed that a front element (100) is placed as being inserted on the front surface of a door frame (72), and a install groove (92) is formed as a ring shape along a front door frame.

A front element is a ring-shaped panel formed of the stainless steel texture which is thin, the strength, external aspect, corrosion resistance are excellent, and a decoration part (D) is formed to express a high classic textured sense and prevent the glaring. a front element is directly cut out from a stainless steel plate as a complete ring shape, or can be united each other after cut out as several divided shape.

Especially, a decoration part (D) is composed as a reflection and irreflection patterns are continually placed, and the reflection/irreflection patterns are possible as forming an irreflection pattern as a relief pattern by an etching process.

That is, an irreflection pattern is relatively formed as a relief pattern that the roughness is higher, and a reflection pattern is a surface which is not etched, and relatively formed as an intaglio form which is smooth and the roughness is low.

A decoration part is formed with a lattice pattern structure that a quadrilateral or rhombus forms are continually placed.

For sure, on this preferred embodiment, forming a reflection pattern is formed on the intaglio part and a irreflection pattern is formed on the relief part is illustrated, but conversely, a irreflection pattern can be formed on the relief part intaglio part and a reflection pattern can be formed on the relief part.

Also, on this preferred embodiment, forming the decoration patterns by an etching method is illustrated, but it isn't limited on this, if it is a method capable of forming an intaglio/relief structure, any of method of the grinding work, photo etching, laser machining and etc. can be used.

A front element (100) that a decoration part (D) is formed is placed with a method which is forcibly inserted on a install groove (92) of a door frame (72). Therefore, a front element is produced as a size that the forcible insertion on a install groove (92) is possible.

Also, a front element (100) is fixed on a by an adhesion element on a install groove (92) of a door front frame (72).

An adhesion element that an adhesion agent and a both-faced tape are typical is previously placed on the lower part of a install groove (92) before a front element is pressed in, and fixes a front element (100) which is inserted on a install groove (92).

A door (60) composed as afore-mentioned is reinforced of the strength by a metallic textured front element (100) as well as having a high classic textured sense by a decoration part (D) having lattice patterns on a front element (100) and prevented of glaring condition.

A door frame (72) is composed as being glided with a metallic texture inflict the same color with a front element to improve the external aspect of a door (60).

On the other hand, as a door ring (200) is formed as a rounded-ring constitution, placed as protruded not toward the front surface of a cabinet cover (62), but forward direction of a washing machine along the circumference of a door on a cabinet cover (62).

A cutting plane of a ring body (201) forming a door ring (200) has a semicircled shape to be bulgily protruded.

And on the cabinet cover (62), several install hole (63) are formed with a certain interval along the circumference of a door (60) that a door ring (200) can be installed, and on a door ring (200), several of hook structured union part (205) are formed each of a certain interval on the behind part of a ring body (201) to be united as being inserted on a install hole (63).

Accordingly, a door ring (200) is installed as a union part (205) is inserted on a install hole of a cabinet cover (62) and fixed on a cabinet cover (62).

It is suitable for a door ring (200) to be manufactured with an injection like synthetic resin etc. and a gliding layer (203) is formed on the surface.

On a door ring (200), manufacturing a ring body (201) and a union part (205) with same material is possible, and a mutual bonding or an assembling after manufacturing each in accordance with requirements.

Also, on a gliding layer, it is possible to compose with the same color or the contrasted color etc. as selecting variously with a decoration part (D) of a cabinet cover (62) or a door (60).

If a door ring (200) is installed around a door (60), with a decoration part (D), a door and a fine view of a door and the circumference, so it contributes to improve the entire external aspect of a washing machine.

Also, On a cabinet cover (62) formed with a usual iron plate material, as a door ring is additionally installed around a laundry entrance (64) supporting a quite weight of the load, the enough strength can be definite capable of supporting a door even if the capacity of a washing machine is enlarged.

The reference observing the manufacturing method will now be made in detail to the preferred embodiment No. 1.

Figure 8:
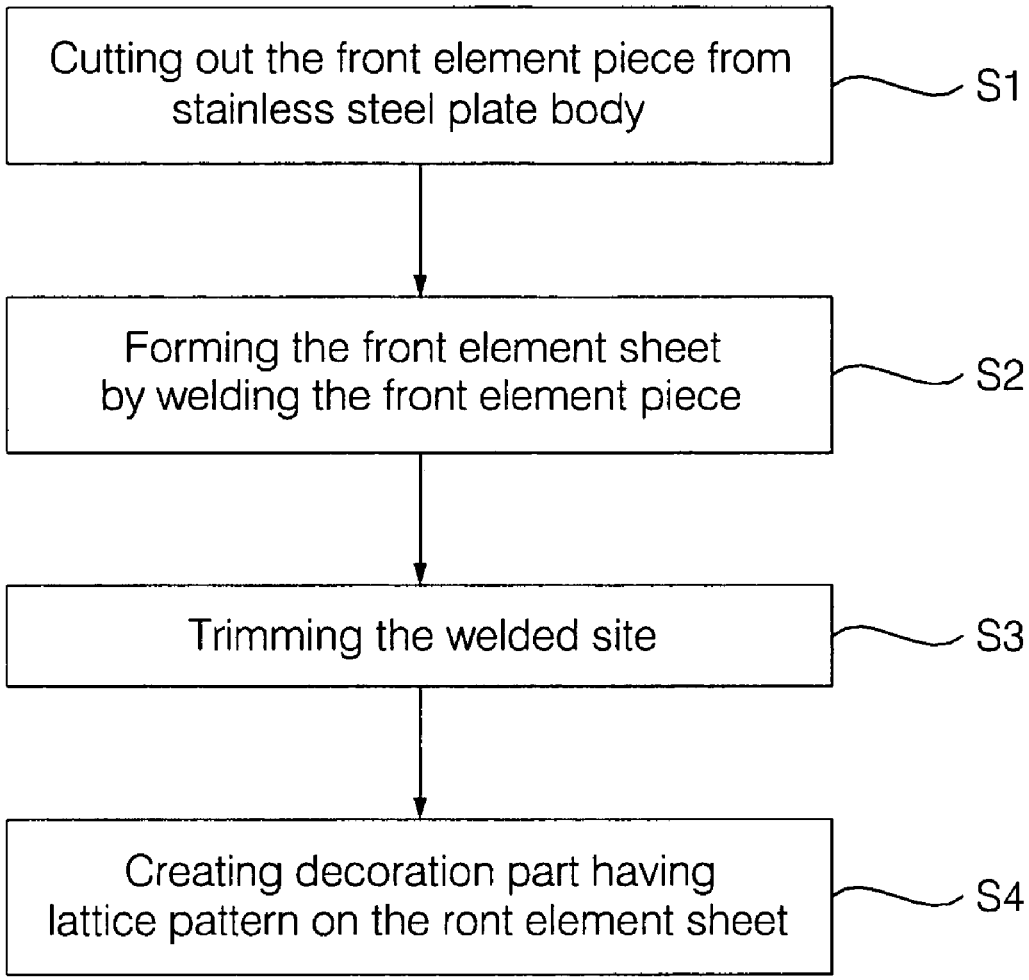
FIG. 8 is a flow chart illustrating the manufacturing method of a front element used on a door of a drum washing machine according to the preferred embodiment No. 1 of the present invention.
Figure 9:
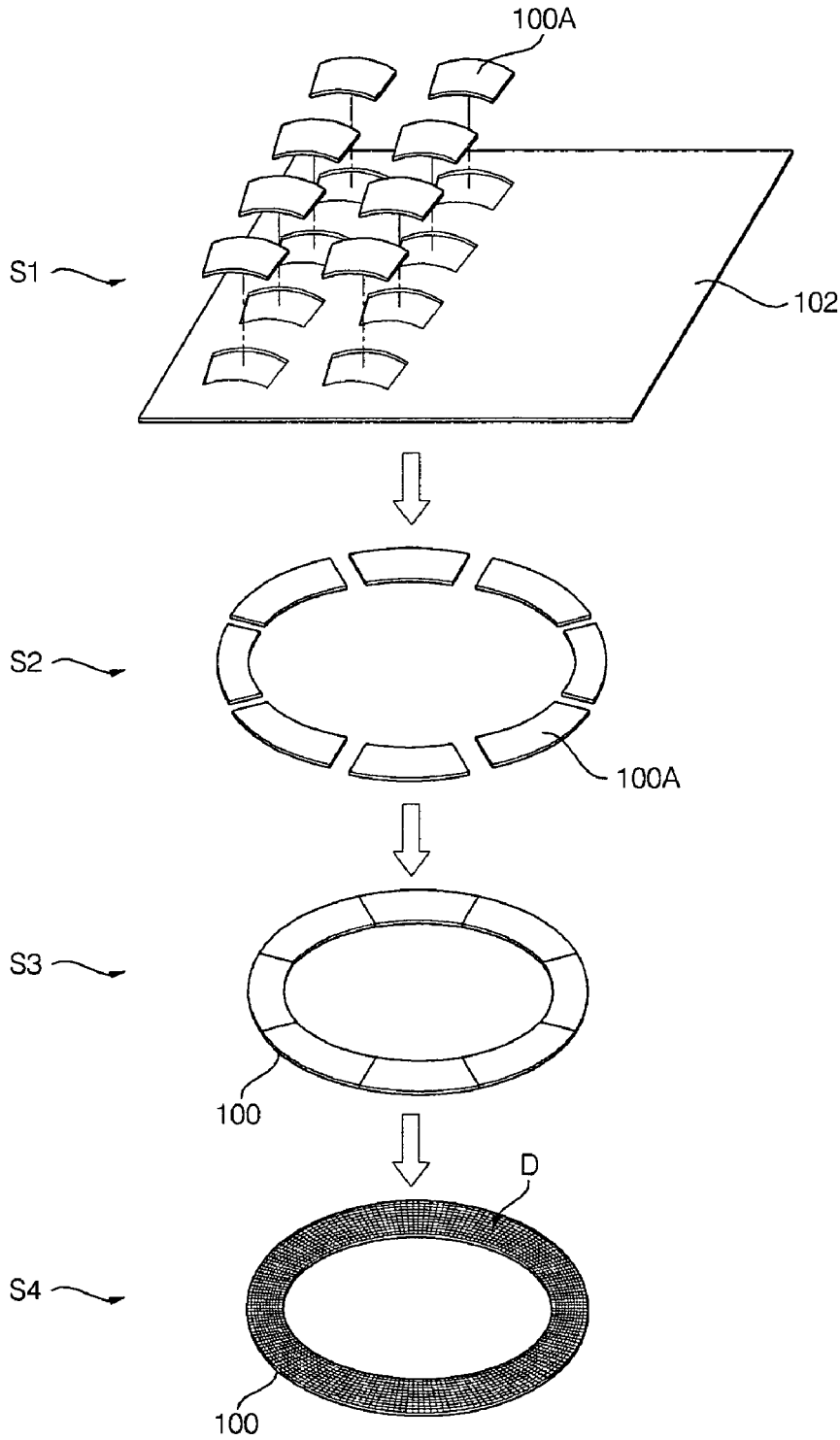
FIG. 9 is a drawing illustrated orderly the manufacturing method of a front element used on a door of a drum washing machine according to the preferred embodiment No. 1 of the present invention.

FIG. 8 is a flow chart illustrating the manufacturing method of a front element used on a door of a drum washing machine according to the preferred embodiment No. 1 of the present invention, and FIG. 9 is a drawing illustrated orderly the manufacturing method of a front element used on a door of a drum washing.

First of all, cut out a ring-shaped front element (100) from a stainless steel plate body (102).

After that, to form a decoration part (D) on the surface of afore-mentioned front element, continually form the reflection/irreflection or intaglio/relief patterns through the etching process.

On a front element (100) formed the decoration part (D), install groove (92) of the front door frame (72) is dimensional processed to fit compulsorily, a both-faced adhesion tape (94) is arranged on the lower part of a install groove (92) of a door frame.

That is, as a front element (100) is inserted on a install groove (92), a front element (100) is fixed as pressed in on a install groove (92) as well as the rear surface of a front element (100) is adhesion fixed on the lower part of a install groove (92) by a both-faced adhesion tape, Therefore, a front element (100) is easily installed with a simple action like inserting on a install groove (92) of a door frame (70).

If a front element (100) is placed as inserted on a install groove of a door frame (70), the strength of a door frame is reinforced by a stainless steel textured front element (100).

Therefore, even if the load of a door glass (90) is increased as a size of a door (60) is enlarged according to the large-sized trend of washing machine, a door glass (90) is supported stably as the strength of a door frame is reinforced.

On the other hand, as illustrated on FIG. 8 to 9, as observing more concretely the manufacturing method of a front element (100), several of front element piece(100A) are cut out from a stainless steel plate body (102) to manufacture front elements (100) on the cutting out procession. (S1)

A stainless steel plate body (102) is a plane plate member having a certain extent, and a front element piece (100A) is cut out by press working.

And, the several front member pieces (100A) are formed as a circular arc form of the same angles, a complete ring-shaped front element (100) is formed as a certain numbers of front element pieces (100A) are united.

That is, a front element piece (70A) is a divided form in the same angle along the column direction, the several pieces are identically formed as a circular arc of a certain angle.

On the welding process, a ring-shaped front element (100) is formed as joining a front element piece (100A) which is cut out on the cutting process by welding. (S2)

At this time, the both ends of the several front element pieces (100A) are connected each other by welding.

On the elaboration process, give the final polish as grinding the welded part of a front element (100) which is completed on the welding process. (S3)

Therefore, the front surface of a front element (100) is processed smoothly, so the discolored by the welding part is restored back as well.

On the texture forming process, on the front surface of a front element (100) which is smoothed on the final polish process, a decoration part (D) is formed having the lattice patterns by the method of etching processing afore-mentioned. (S4)

Therefore, the afore-mentioned manufacturing method of a front element (100), compare with the method that a front element (100) is cut as a ring shape directly from a stainless steel plate body (102) is prevented losing unnecessary material of a stainless steel plate body (102).

On the other hand, a front element (100) formed a decoration part (D) through the afore-mentioned process is united as adhere on a door frame (70) using a adhesion element (94) as shown on FIG. 7.

Figure 10:
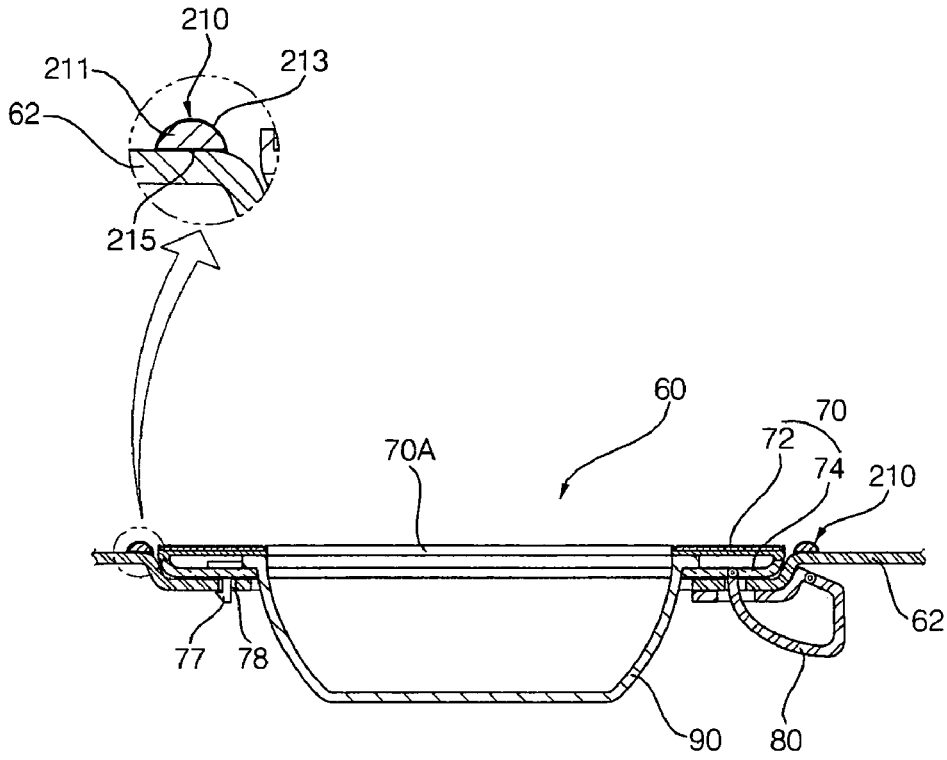
FIG. 10 is a plane cross-sectional view illustrating a drum washing machine having a door ring according to the preferred embodiment No. 2 of the present invention.

FIG. 10 is a plane cross-sectional view illustrating a drum washing machine having a door ring according to the preferred embodiment No. 2 of the present invention.

For reference, the same reference numbers are given for the same or similar composition elements with the composition of the preferred embodiment NO. 1 and the detailed descriptions are omitted.

On a washing machine according to the preferred embodiment No. 2 of the present invention, as illustrated on FIG. 10, a door ring (210) is installed on the front surface of a cabinet cover (62), and other compositions are the same and similar with the compositions of the afore-mentioned preferred embodiment No. 1.

A door ring (210) is installed along the outside girth of a door as the afore-mentioned preferred embodiment No. 1, but on the present embodiment, installed as a form which is attached on a cabinet cover (62) by an adhesion element (215).

And a gliding layer that a metallic material is glided is formed on the surface of a ring body (211) of a door ring (210).

Because a door ring (210) afore-mentioned is installed as being attached on a cabinet cover (62) using an adhesion element (215), without separate processing of a cabinet cover (62) a dooring (210) is installed on a cabinet cover (62) easily, so the external fine view is improved as well as the strength of the structures around a door is reinforced.

Figure 11:
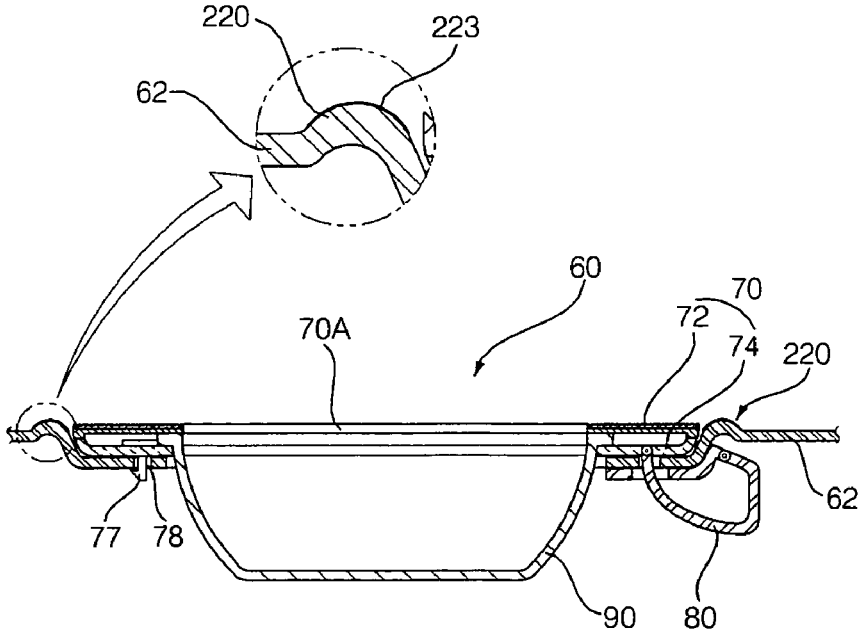
FIG. 11 is a plane cross-sectional view illustrating a drum washing machine having a door ring according to the preferred embodiment No. 3 of the present invention.

FIG. 11 is a plane cross-sectional view illustrating a drum washing machine having a door ring according to the preferred embodiment No. 3 of the present invention.

The same reference numbers are given for the same or similar composition elements with the composition of the preferred embodiment NO. 1 and the detailed descriptions are omitted.

As illustrated on FIG. 11, a drum washing machine according to the preferred embodiment No. 3 of the present invention, a door ring (220) is formed as one body on a cabinet cover (62), and other compositions are the same and similar with the compositions of the afore-mentioned preferred embodiment No. 1.

That is, on a cabinet cover (62), a door ring (220) which is bulgily protruded as a rib or a bead shapes is formed as bended.

For sure, on the external surface of a door ring (220) a gliding layer (223) can be formed with the metallic material etc.

On a drum washing machine of the present preferred embodiment, as a door ring (220) is directly formed on a cabinet cover (62), improving the external aspect of a door and the circumference, and reinforcing the strength around a door without attaching any special structures.

Figure 12:
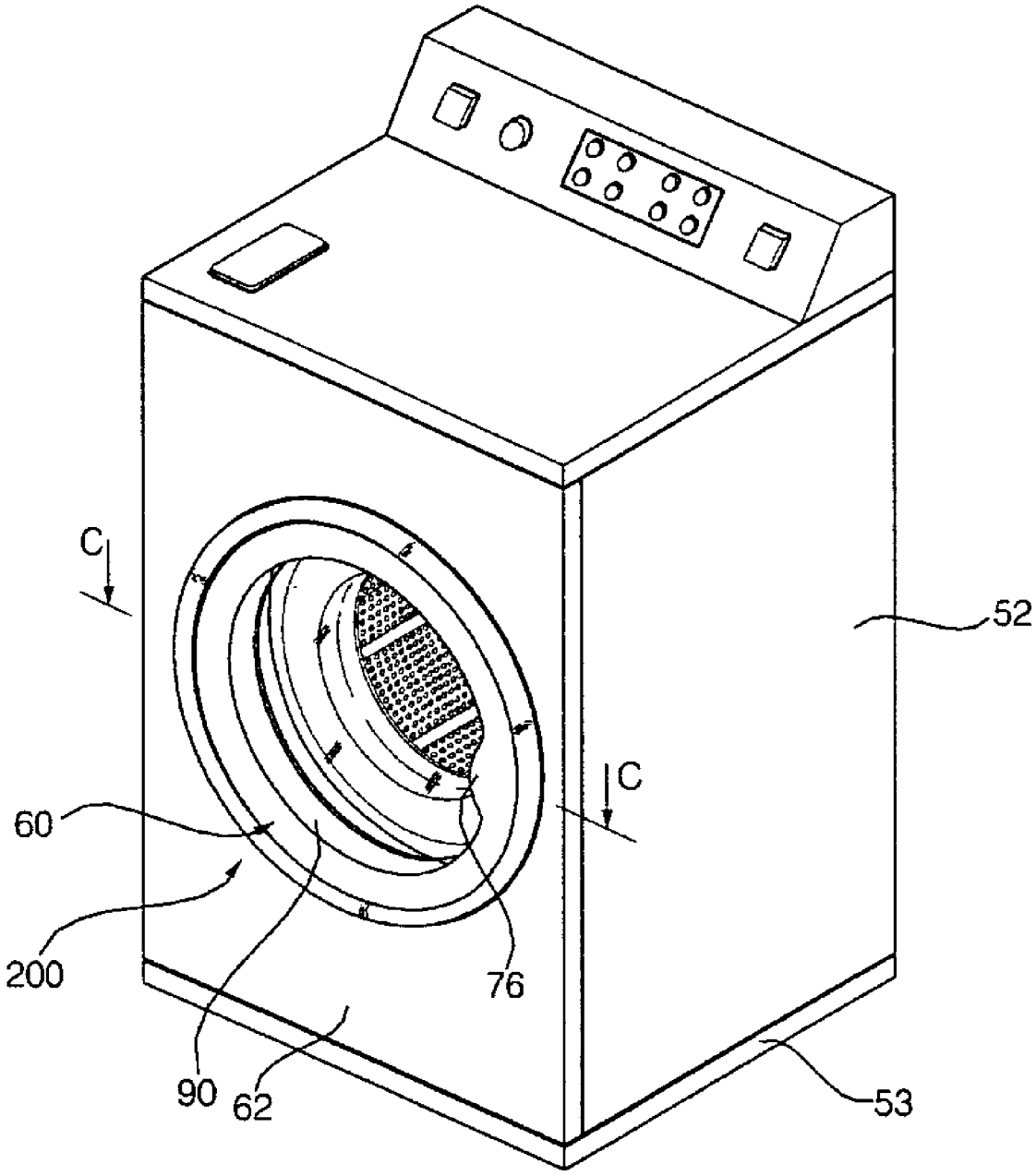
FIG. 12 is a plane cross-sectional view illustrating a drum washing machine having a door ring according to the preferred embodiment No. 4 of the present invention.
Figure 13:
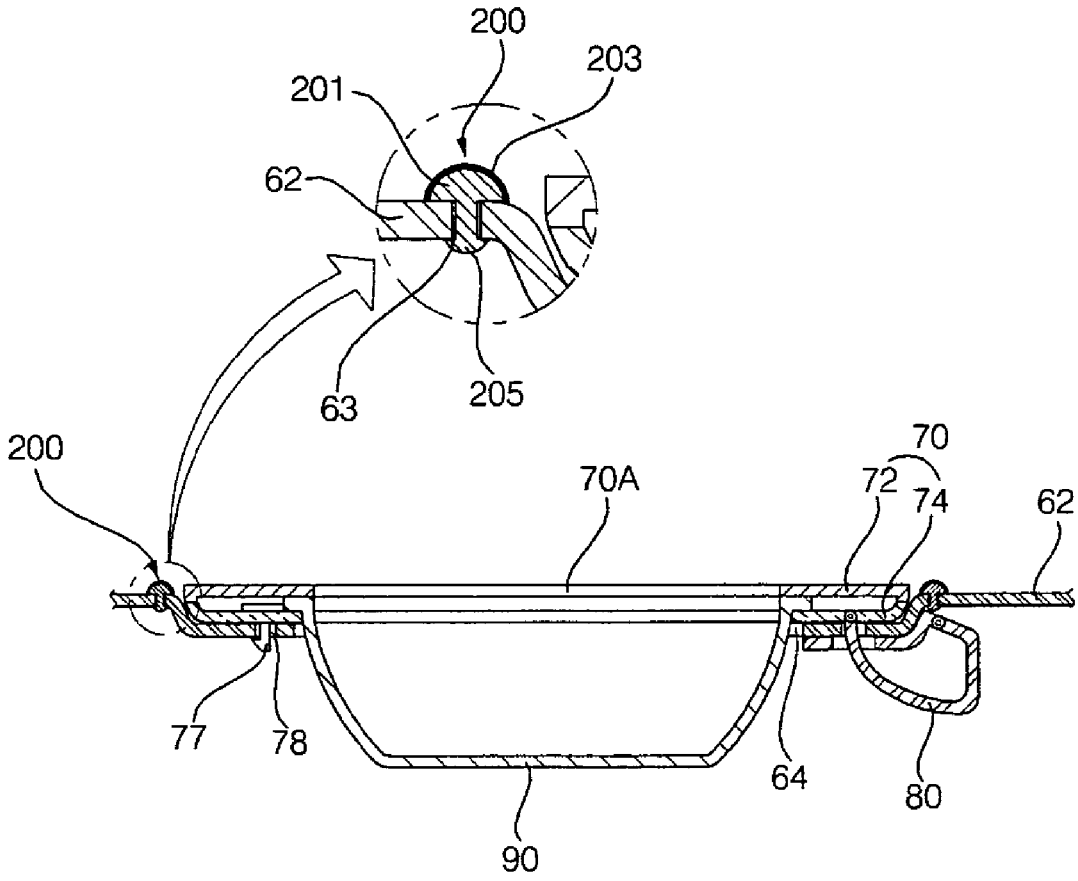
FIG. 13 is a plane cross-sectional view according to the line C-C direction of FIG. 12.

FIG. 12 is a plane cross-sectional view illustrating a drum washing machine having a door ring according to the preferred embodiment No. 4 of the present invention, and FIG. 13 is a plane cross-sectional view according to the line C-C direction of FIG. 12.

The same reference numbers are given for the same or similar composition elements with the composition of the preferred embodiment NO. 1 and the detailed descriptions are omitted.

As illustrated on FIG. 12 to 13, a drum washing machine according to the preferred embodiment No. 4 of the present invention, a decoration part (D) isn't formed on a door frame (70) of a door (60), a door ring is installed on a cabinet cover (62) around a door (60), and other compositions are the same and similar with the compositions of the afore-mentioned preferred embodiment No. 1.

That is, a door is composed of: a front door frame (72); rear door frame (74); a door glass (90) constructed between the door frame (70); on a cabinet cover (62) formed a door (60), the door ring (200) with the afore-mentioned preferred embodiment No. 1.

A door ring (200), a ring body (201) and a union part (205) protruded to the behind direction, is placed as inserted on a install hole (63) of a cabinet cover (62).

For sure, it is possible for a door ring (200) to be attached using a adhesion element as the afore-mentioned preferred embodiment No. 2 and be composed as one body on a cabinet cover (62) as the afore-mentioned preferred embodiment No. 3.

The external fine view is improved as well as the strength of the structures around a door is reinforced as a door ring (200) is installed around a door on the present preferred embodiment.

Figure 14:
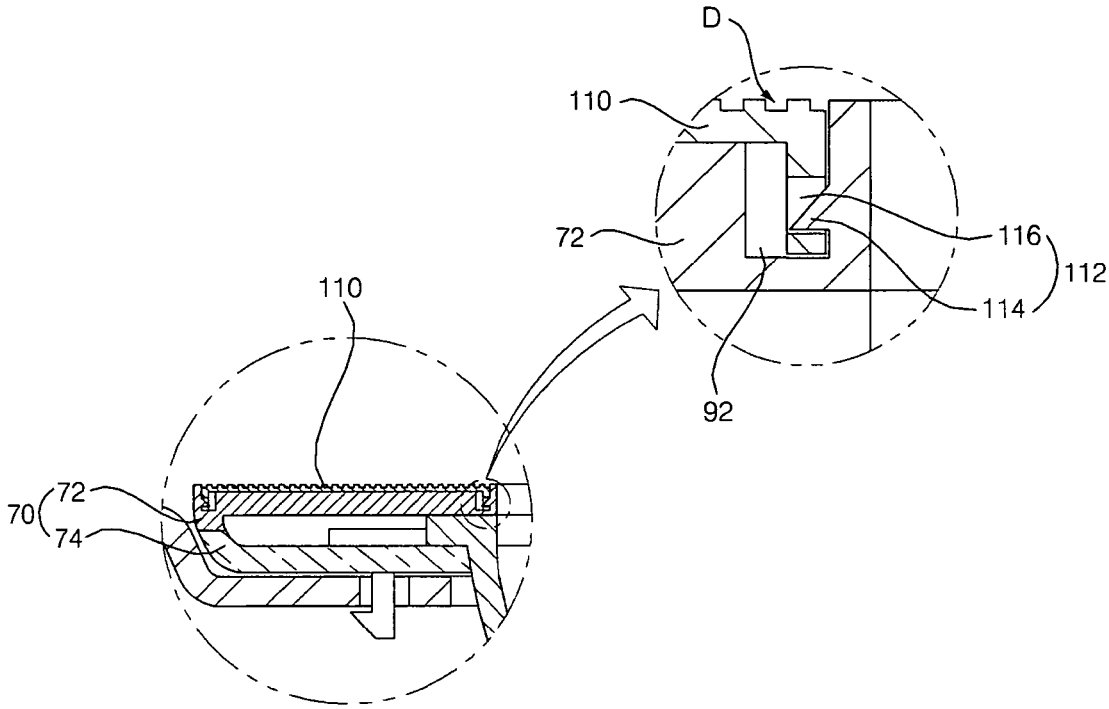
FIG. 14 is a plane cross-sectional view illustrating a major part of a door of a drum washing machine according to the preferred embodiment No. 5 of the present invention.
Figure 15:
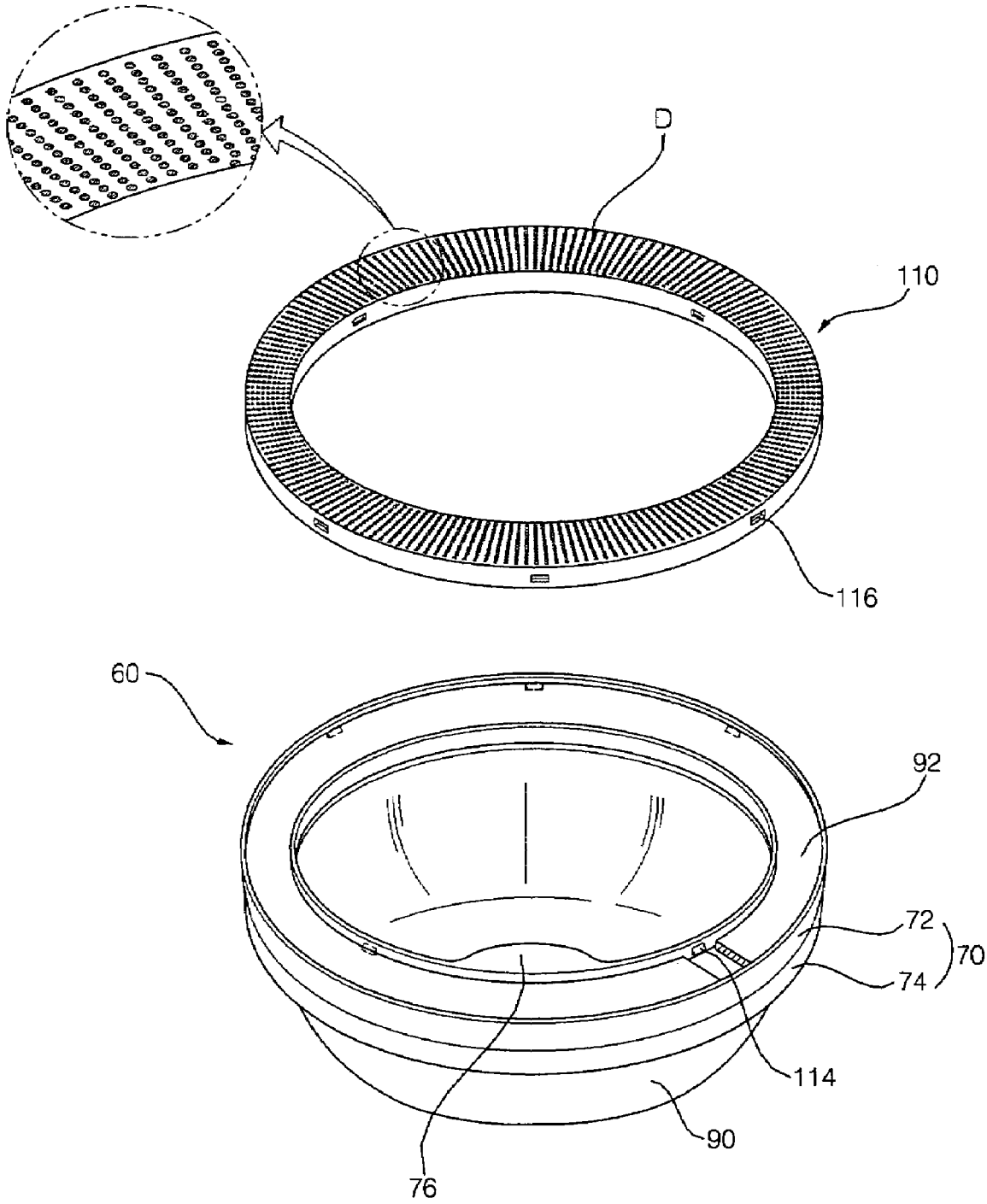
FIG. 15 is a disassembled perspective view of a door not showing some parts of a drum washing machine according to the preferred embodiment No. 5 of the present invention.
Figure 16:
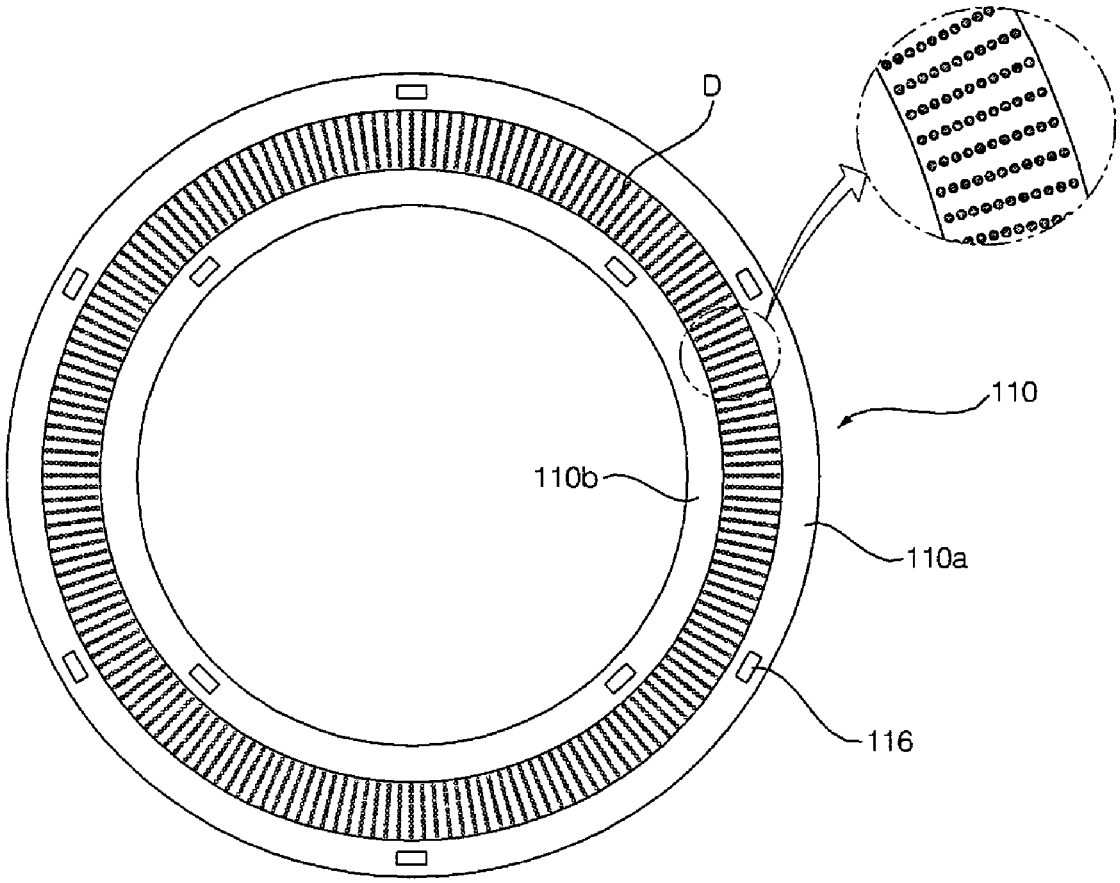
FIG. 16 is a plane diagram illustrating an afore state of a front element bended according to the preferred embodiment No. 5 of the present invention.
Figure 17:
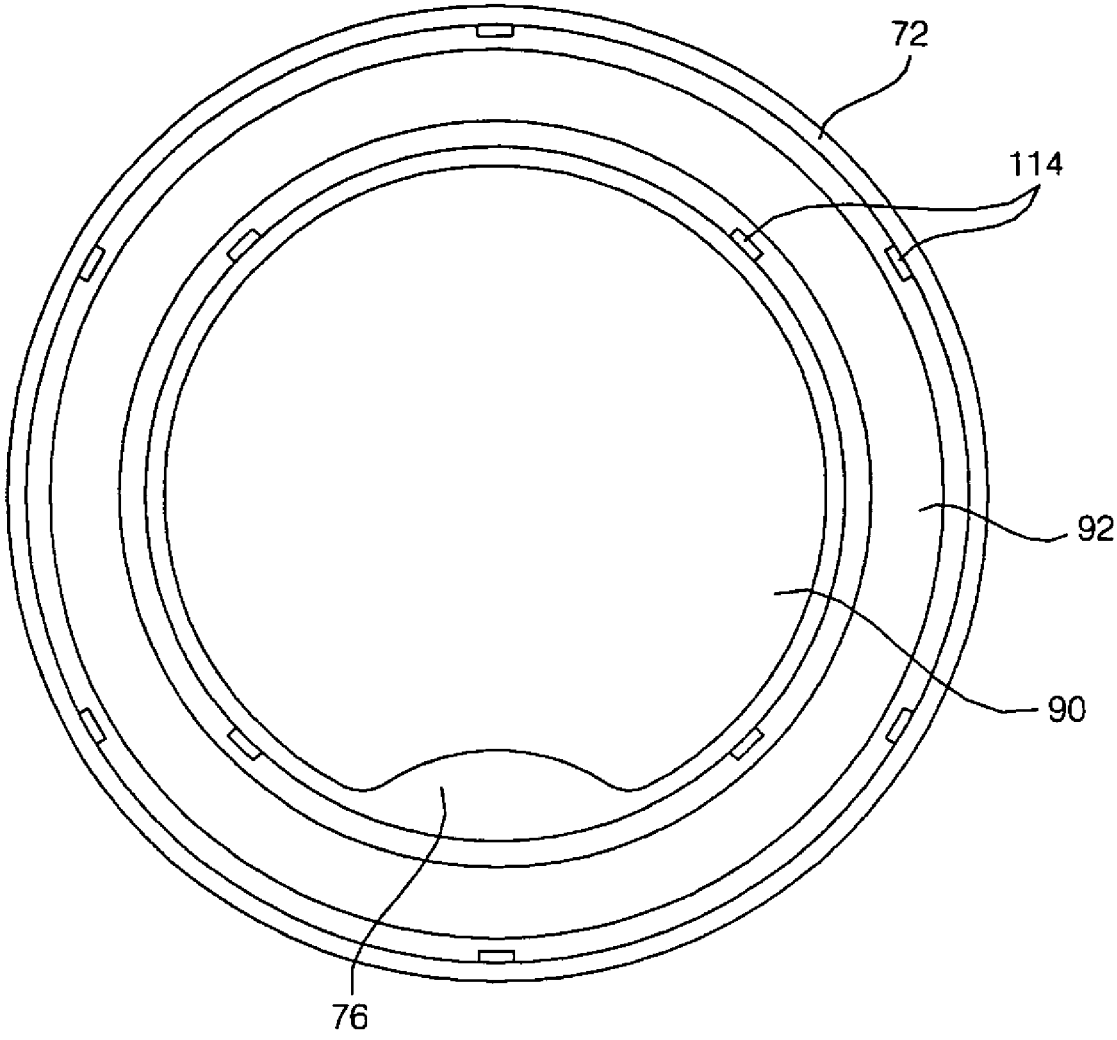
FIG. 17 is a plane diagram illustrating a superior surface of a door that a front element is operated according to the preferred embodiment No. 5 of the present invention.

C-C direction of FIG. 12;

FIG. 14 is a plane cross-sectional view illustrating a major part of a door of a drum washing machine according to the preferred embodiment No. 5 of the present invention, FIG. 15 is a disassembled perspective view of a door not showing some parts of a drum washing machine according to the preferred embodiment No. 5 of the present invention, and FIG. 16 and FIG. 17 are plane diagrams illustrating an afore state of a front element bended and a superior surface of a door that a front element is operated according to the preferred embodiment No. 5 of the present invention.

For reference, the same reference numbers are given for the same or similar composition elements with the composition of the preferred embodiment NO.1 and the detailed descriptions are omitted.

As illustrated on FIG. 14 to 17, a drum washing machine according to the preferred embodiment No. 5 of the present invention is including: a door that a front element is fixed on a install groove (92) which is formed on a door frame (70) by a joint element as well as the patterns on the surface of a front element of a decoration part (D) are formed differently each other, and other compositions are the same and similar with the compositions of the afore-mentioned preferred embodiment No. 1.

The patterns of a decoration part (D) is a structure that several round-shaped patterns are continually formed. The patterns like this are possible as forming the round-shaped pattern to be intaglioed through the etching method.

For sure, rest of the parts which isn't formed as round-shaped, are formed as embossed, and formed smoother surface relatively than the intagioed part.

Next, a joint element (112) is comprising: a hitch projection (114) formed on a install groove (92), a hich hole (116) formed on a front element (110), that a hitch projection (114) is hitched as being inserted.

A hitch hole (116) is formed on each of the edge parts (100*a*, 110*b*) of the external aspect and the inner aspect of a front element (110), and the external edge part (110*a*) and inner edge part (110*b*) of a front element (110) are bended toward the lower direction to be adhered on each of the inner aspect part and the external aspect part of a install groove (92).

Therefore, if a front element (110) is inserted on a install groove (92), a front element (110) is fixed as hitch projection (114) is fixed as inserted hitched on a hitch hole (116).

At this time, a front element (110) is formed as a "U" like section which opened toward the lower direction, a install groove (92) is formed on the inner side as a "U" like section that an unevenness is formed opposed with a front element. Therefore, a front element (110) is stably and safely reached on the inner part of a install groove (92).

On a hitch projection (114), as an inclination part is formed toward the inserting direction of a front element (110), a front element is easily inserted on a install groove (92), on the other side, an inclination part isn't formed toward to the removing direction of a front element, the breaking away of a front element (110) from a install groove (92) is prevented.

A hitch hole (116) and a hitch projection (114) formed as afore-mentioned are formed as confronted each other, and several pieces are formed as isolatedly with a certain interval along the column direction a front element (110) and a install groove (92).

Reference on the manufacturing method of a door of a drum washing machine will now be made in detail to the preferred embodiment No. 5 of the present invention.

Firstly, a ring-shaped front element (110) is cut as a fixed size from a stainless steel plate body (102), a decoration part (D) is formed as continually forming the round-shaped structure through the method of etching and etc. on the front surface.

In addition, a front element is formed as the inner aspect edge part (110*a*) and external aspect edge part (110*b*) are extended, several pieces of hitch hole (116) is formed toward the column direction as isolated with a certain interval on the inner aspect edge part (110*a*) and external aspect edge part (110*b*).

The edge parts (110*a*, 110*b*) of a front element (110) formed a hitch hole (116) is bended toward the lower direction that a decoration part (D) isn't formed so as to be adhere closely on the inner aspect part and the external aspect part of a install groove (92) when a front element (110) is placed on a install groove (92) of a door frame.

That is, if a front element (110) is inserted on a install groove (92) of a door frame (70), the bended part of a front element (110) is adhere closely on the either aspect, a hitch projection (114) which is formed on a install groove (92) is hitched as being inserted on the hitch hole (116).

At this time, a hitch hole (116) and a hitch projection (114) formed as afore-mentioned are formed as confronted each other, and several pieces are formed as isolatedly with a certain interval along the column direction a front element (110) and a install groove (92).

Therefore, a front element (110) bends the edge parts (110*a*, 110*b*) after forming a decoration part (D) and a hitch hole (116), after that, with a method fixing a door frame (70) into a install groove (92), simply installed.

On the other hand, As other manufacturing method of a door is the same as afore-mentioned preferred embodiment No. 1, the detailed explanations are omitted.

Figure 18:
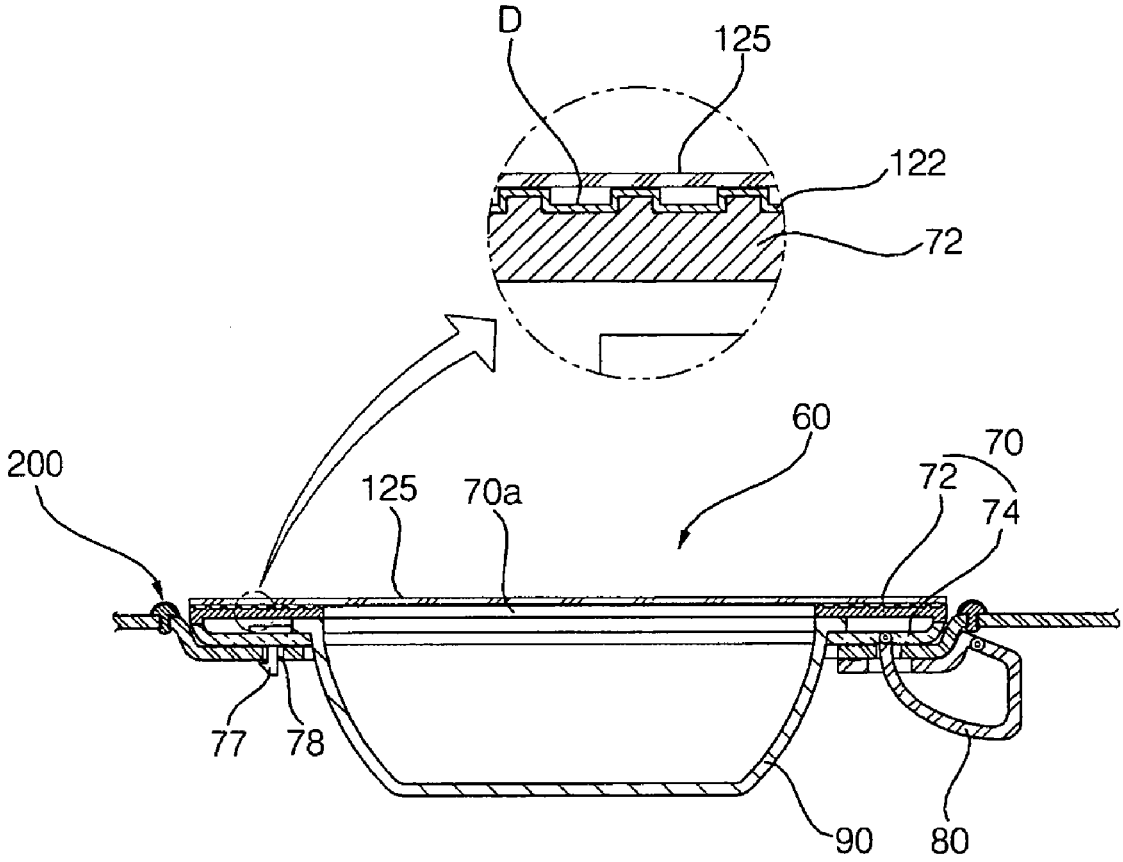
FIG. 18 is a plane cross-sectional view illustrating a door of a drum washing machine according to the preferred embodiment No. 6 of the present invention.
Figure 19:
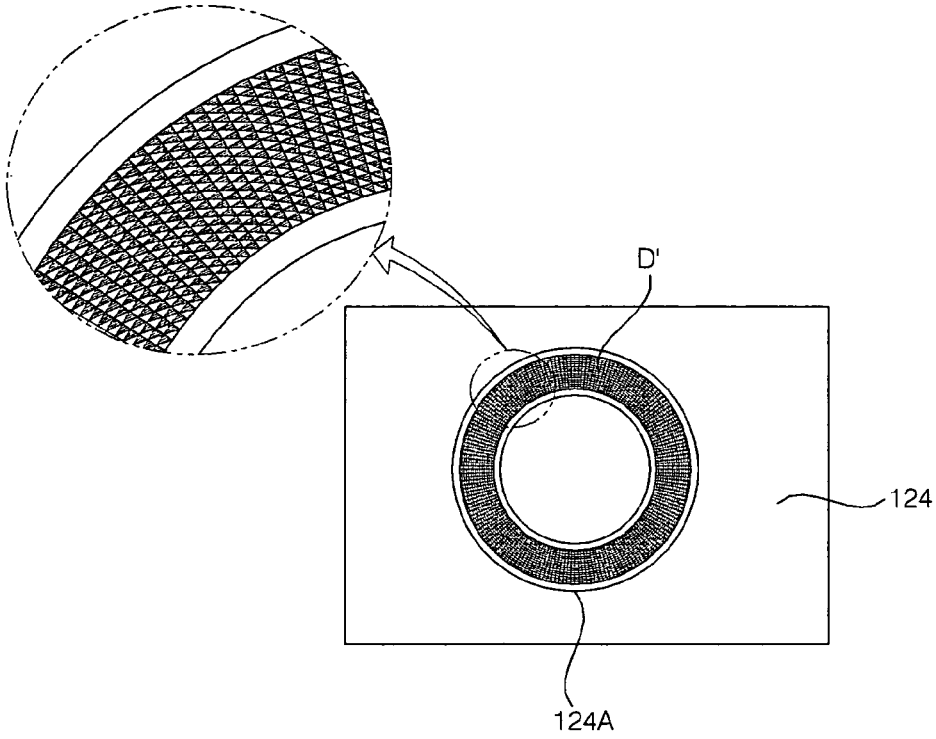
FIG. 19 is a plane diagram illustrating the inner side of a mold for molding a door frame according to the preferred embodiment No. 6 of the present invention.

FIG. 18 is a plane cross-sectional view illustrating a door of a drum washing machine according to the preferred embodiment No. 6 of the present invention, and FIG. 19 is a plane diagram illustrating the inner side of a mold for molding a door frame according to the preferred embodiment No. 6 of the present invention.

For reference, the same reference numbers are given for the same or similar composition elements with the composition of the preferred embodiment No. 1 and the detailed descriptions are omitted.

As illustrated on FIG. 18 to 19, a drum washing machine according to the preferred embodiment No. 6 of the present invention, on the front surface of a door frame (70) a decoration part (D) is directly formed, and including a door formed a metallic textured gliding layer (122) on the surface a decoration part (D), and other compositions are the same or similar with the afore-mentioned preferred embodiment No. 1.

A decoration part (D) is formed as one body at the same time on a rear door frame (72) during the injection molding of a front door frame (72), and a lattice form continued by relief and intaglio forms on the surface of a front door frame (72).

That is, on the injection molding (124) of a front door frame (72), as illustrated on FIG.19, a decoration model (D') is formed on a cavity (124A) which is forming the front surface of a front door frame, as a front door frame (72) is injection molded with an injection mold (124), a decoration part is formed as a confronted form with the decoration model (D') of an injection mold on the front part of a front door frame (72).

On a decoration model (D'), a cell unit form is a lattice structure having a trilatral shape as shown on FIG. 19, and as the same shape as afore-mentioned, reflection/irreflection or relief/intaglio structures are continued.

Also, on a decoration model (D'): it is suitable that the parts irreflection or relief are formed as a trilatral lattice structure is rougher than the parts that reflection or intaglio are formed, and for sure, the opposite structure is possible.

On the surface of a front door frame (72) that a decoration part is formed, a metallic textured a chromium gliding layer (122) is formed.

And, a rounded plate form capable of covering the entire external surface is formed above the chromium gliding layer (122), and a transparent textured protective coating (125) can be worn.

Reference on the manufacturing method of a door of a drum washing machine will now be made in detail to the preferred embodiment No. 6 of the present invention.

Figure 20:
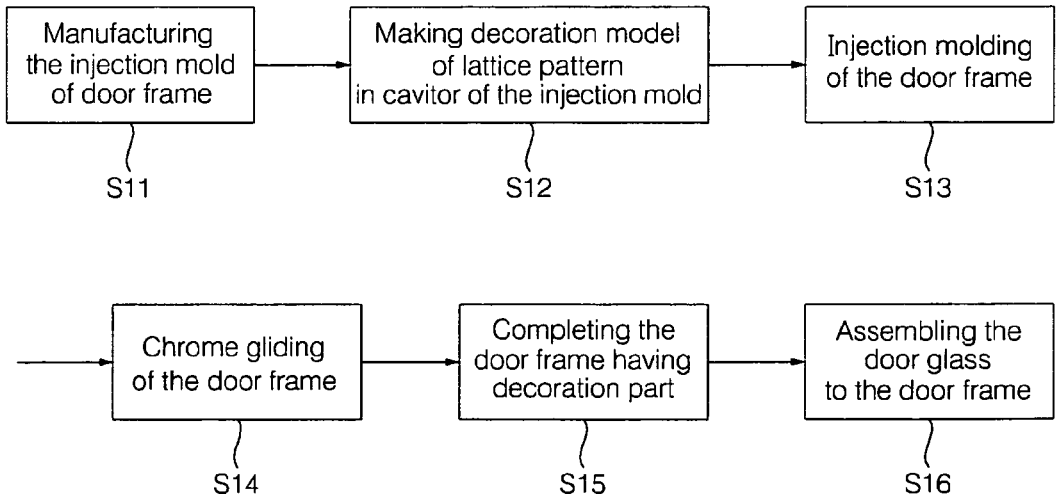
FIG. 20 is a flow chart illustrating the manufacturing method of a door having a decoration part according to the preferred embodiment No. 6 of the present invention.

FIG. 20 is a flow chart illustrating the manufacturing method of a door having a decoration part according to the preferred embodiment No. 6 of the present invention.

Firstly, on the texture forming process, a decoration model (D') having a lattice structure is formed on an injection mold (124) of a front door frame so as a decoration part (D) to be formed on the front surface of an injection molded front door frame (72). (S11, S12)

That is, a decoration model (D') is formed by an etching process on a cavity (124A) one of the injection molds (124) of a door frame (72). Usually for a corrision management method, a photo etching technic is used to form a decoration model (D'), on a cavity (124A) of a injection mold (124).

On the injection process, a front door frame (72) is injection molded as using an injection mold formed a decoration model on the texture forming process (S13).

Therefore, a front door frame is injection molded from an injection mold (124) in a condition that a decoration part (D) having a latticed structure on the front surface is completed in one body. The major material of a door frame (70) is a plastic material that the special injection quality is excellent, the weight is low, and which is having a certain level of strength.

On the gliding process, a metallic gliding which inflicts the more of a high classic sense is completed on the external aspect of a door frame which is injected on the injection process. (S14, S15)

As the gliding material, chromium that a fine sense and inner abrasion quality are superior is broadly used. A luster of metallic quality is polished by the chromium gliding layer (122) as the front door frame (72), inflicts a high classic textured sense compared with a plastic surface.

Therefore, a door (60) of a drum washing machine forms a decoration part (D) on the surface of a door frame (70), and a chromium is glided on the decoration part (D), so the external aspect of a door (60) becomes high-classic.

After that, after coating the protection film (125) on a decoration part (D) of a door frame (72) which is manufactured as afore-mentioned, a door (60) is completed as assembling a door glass (90) on a center hole (70A) of a door frame (72). (S16) FIG. 21 is a plane cross-sectional view illustrating a door of a drum washing machine according to the preferred embodiment No. 7 of the present invention.

For reference, the same reference numbers are given for the same or similar composition elements with the composition of the preferred embodiment NO. 1 and the detailed descriptions are omitted.

Figure 21:
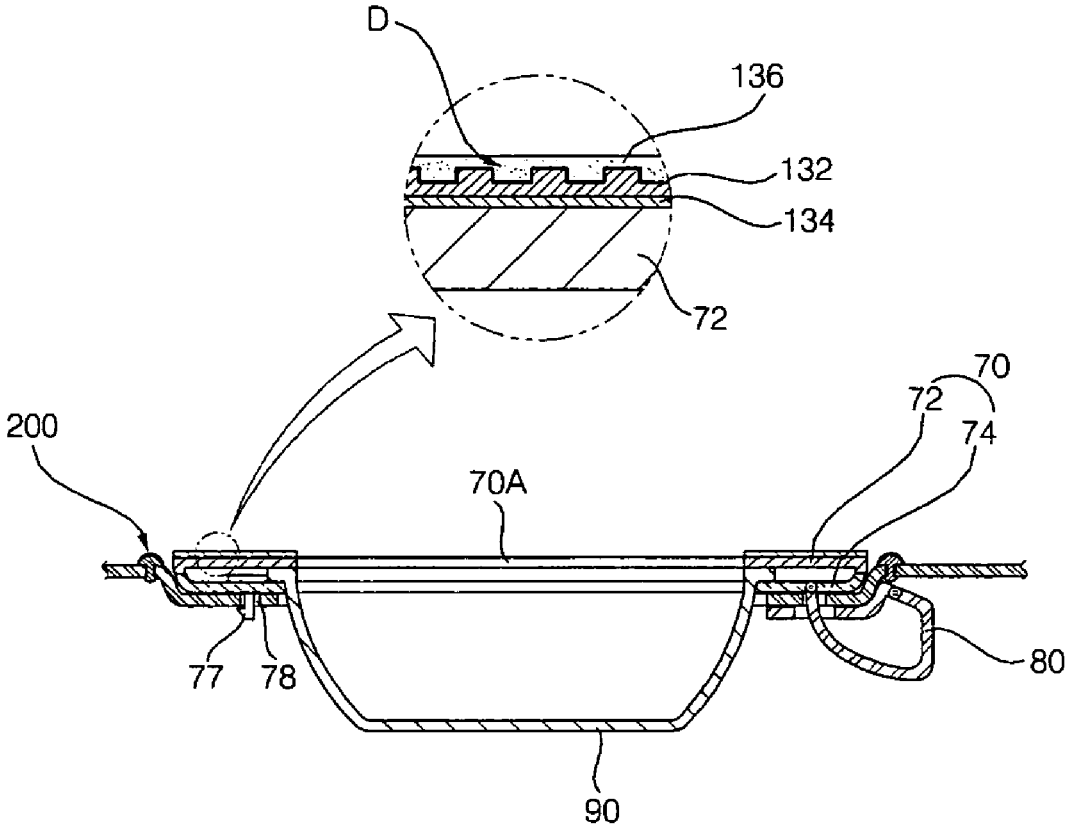
FIG. 21 is a plane cross-sectional view illustrating a door of a drum washing machine according to the preferred embodiment No. 7 of the present invention.

As illustrated on FIG. 21, a drum washing machine according to the preferred embodiment No. 7 of the present invention including: a metallic gliding layer formed on the front surface of a door frame (70), a door directly formed a decoration part (D) on the metallic gliding layer (132), and other compositions are the same or similar with the afore-mentioned preferred embodiment No. 1.

A gliding layer (132) with metallic material like chromium is formed on a front door frame (72), and a decoration part is formed on the gliding layer (132).

A decoration part (D) is formed an intaglio/relief structure by the corrosion management method through the photo etching or a laser processing method on the chromium gliding layer (132), it is suitable for the relief part to have a irreflected surface.

If a door frame (72) is formed on the surface of a decoration part (D), a protection coating (136) is worn to protect a decoration part (D).

A protection film is formed as a transparent texture capable of showing a decoration part (D), the color and polish can be controlled according to a user's taste and trends.

Reference on the manufacturing method of a door of a drum washing machine will now be made in detail to the preferred embodiment No. 7 of the present invention.

Figure 22:
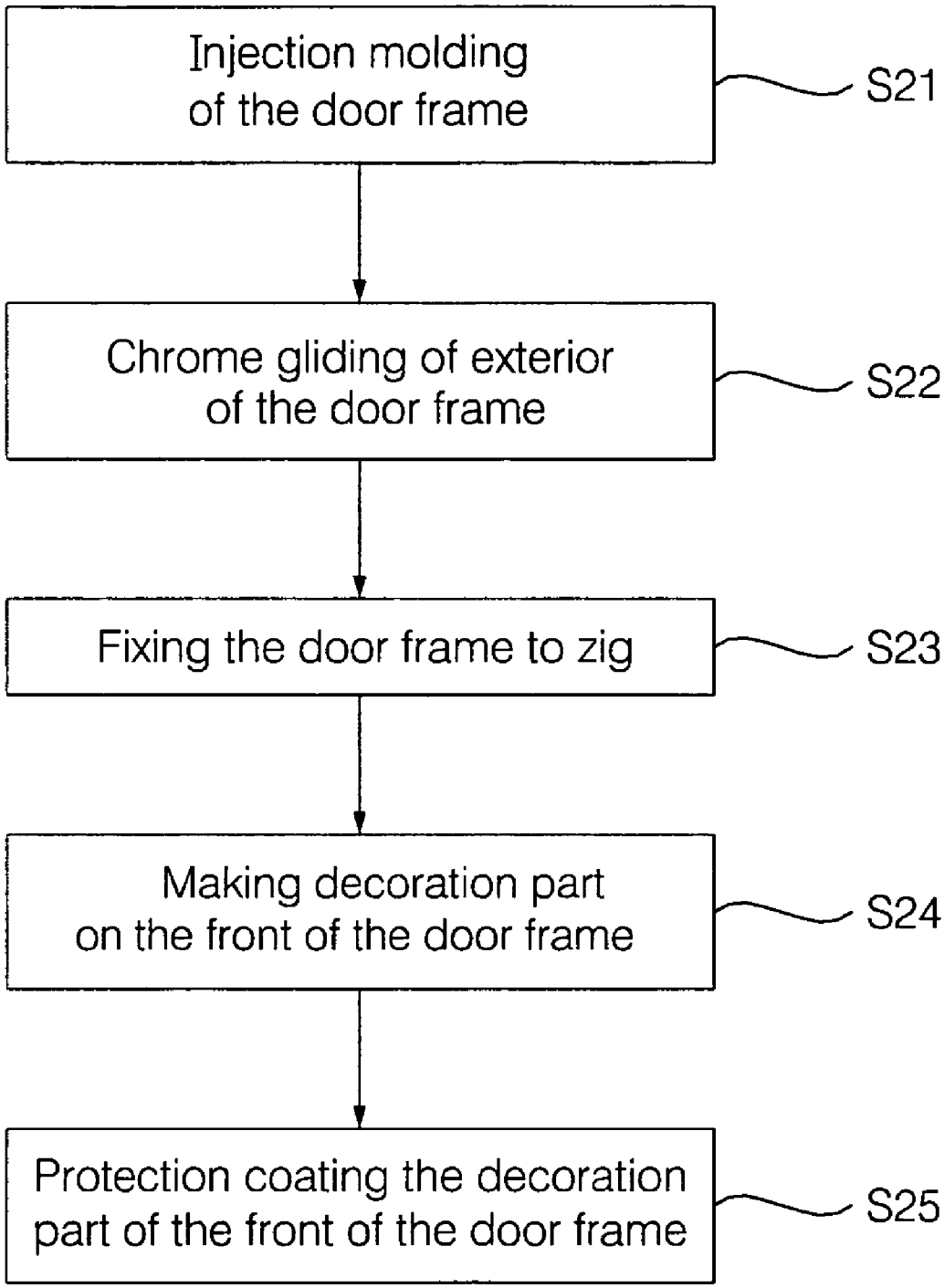
FIG. 22 is a flow chart illustrating the manufacturing method of a door having a decoration part according to the preferred embodiment No. 7 of the present invention.

FIG. 22 is a flow chart illustrating the manufacturing method of a door having a decoration part according to the preferred embodiment No. 7 of the present invention.

Firstly, as injection molded with a metallic texture on a door frame (70) which is injected with a plastic texture on the gliding process, raise the sense of quality of a door. (S21, S22) That is, on the door (60), glide on a front door frame (72) among the door frames (90) with a metallic texture so as no to decrease the fine view by the plastic textured sense of a door frame (70).

For the. gliding material, chromium which gives the consumers the high classic textured sense, and that the abrasion quality is superior, chromium is used typically.

On the texture forming process, as forming a decoration part (D) continued with intaglio and relief structures by etching or I on the front part of a glided front door frame on the gliding process (72) (S23, S24).

By the processed decoration part (D), the front external aspect of a door (60) capable of having a high classic texture and preventing the glaring, so the marketability of a drum washing machine is improved.

On the coating procession, a protecting coating (136) is worn on the front surface of the decoration part (D) of the front door frame (72) on the texture forming process to prevent etching and damages.

The natural gift sense and hardness of the chromium used for gliding of a front door frame (72) are excellent, but the adhesion property on the surface of plastic is low, usually, after gliding copper on the surface of the front door frame (72), glide chromium on the copper gliding layer (134).

That is, as gliding copper which is relatively glided well on the plastic texture of a front door frame (72), after forming a copper gliding layer (134), forming a chromium gliding layer as gliding chromium on the surface of a copper gliding layer (134).

At this time, if process to form a decoration part (D) on the texture forming process, as the chromium layer is worn off, a part of copper gliding layer (134) is bared out of exterior. As copper is different to chromium, a metal which is corroded well, the corrosion which is progressed on the bared copper gliding layer (134), on the contrary, decrease the external aspect of a door (60).

Therefore, to prevent the corrosion condition, the corrosion resistance protecting coating (136) is covered on the front surface of a front door frame (72) a decoration part is formed.

Also, the corrosion resistance protecting coating (136) prevents the situation that a decoration part (D) is injured or damaged by the exterior impact, make the surface of the continued by the intaglio and relief which could be rough smooth.

On the other hand, as a corrosion resistance protecting coating (136) is composed of a transparent texture, the high classic sense of a door (60) in order to the gliding of chromium and form of a decoration part (D) is visually transmitted to the consumers.

As the color and the luster of a corrosion resistance protecting coating (136) can be controlled according to the materials and the coating method, giving the proper texture quality on the front surface of a door frame (70) according to the necessity.

On the other hand, the manufacturing method of a washing machine and a door of a washing machine in accordance with the present invention are explained as referring to the illustrated figures, the present invention isn't limited to the preferred embodiment, the various transformation is surely possible on the extent of the technique abstraction of the invention.

That is, a composition of the external surface of a door ring of the present invention that a gliding layer is formed is illustrated, but according to the preferred condition, coating with a transparent material can be possible, and forming the various reflection/irrefletion or intaglio/relief patterns is possible.

Also, on the afore-mentioned preferred embodiment, the patterns on a decoration part isn't limited to trilateral shape, quadrilatral shape, lattice shape, round shape, reflection/irrefletion or intaglio/relief structures can be realized according to the preferred condition.

As afore-referenced, the manufacturing method of a washing machine and a door of a washing machine in accordance with the present invention is: as a front member is installed on the front surface of a door frame, without composing the entire door frame as metallic material or special material, reinforcing the entire strength is possible. Also, as the strength of a front member is reinforced as being installed on a door frame, a door glass having a heavy weight as enlarged is supported stably by a door frame.

Also, as a decoration part is formed on a front member of a door frame or directly formed on a door frame, a fine view of a door is improved.

Also, as a decoration part is formed of a reflection/ irrefletion or intaglio/relief structure, and as the glaring condition is prevented as the light is diffused reflected, a user's inconvenience is decreased.

Also, the fine view of a decoration part of a door is improved, and as the image of a product becomes high classic, the consumer's esthetical desire is satisfied, and the marketability of the washing machine is improved.

Also, a door ring is placed on a cabinet around a door of a washing machine of the present invention, reinforcing the strength of the structures around a door as well as improving the fine view of a front surface of a washing machine.

What is claimed is:

1. A washing machine, comprising:

a door rotatably installed on a cabinet so as to open and close a laundry opening in the cabinet, wherein the door comprises:

a door frame including a ring shaped installation groove;

a front element force fit in the installation groove, wherein the front element comprises a plurality of front element pieces that are joined to each other; and an adhesion element positioned between the front element and the installation groove so as to fix the front element in the installation groove; and a door ring provided at a front surface of the cabinet surrounding an external circumference of the door.

2. The washing machine of claim 1, wherein the door ring protrudes outward from the front surface of the cabinet.

3. The washing machine of claim 2, wherein the door ring includes a gliding layer on an external surface thereof.

4. The washing machine of claim 2, wherein the door ring is coupled to the cabinet by a hook or an adhesion element.

5. The washing machine of claim 2, wherein the door ring comprises a bend formed in the front surface of the cabinet.

6. The washing machine of claim 1, wherein the front element forms a front surface portion of the door.

7. The washing machine of claim 6, wherein the front element includes a decoration part on which intaglio and relief patterns are repeatedly formed.

8. The washing machine of claim 6, wherein the front element includes a decoration part on which reflection and irreflection patterns are repeatedly formed.

9. The washing machine of claim 8, wherein the decoration part is formed as one of a lattice shape, a round shape, a quadrilateral shape, or a trilateral shape.

10. The washing machine of claim 8, wherein the reflection and irreflection patterns are formed as intaglio and relief patterns.

11. The washing machine of claim 10, wherein the intaglio and relief patterns are formed by an etching method.

12. The washing machine of claim 1, further comprising a decoration part on which intaglio and relief patterns are repeatedly formed on a front surface of the front element.

13. The washing machine of claim 12, wherein a metal gliding layer is formed on a front surface of the decoration part.

14. The washing machine of claim 1, further comprising decoration part on which reflection and irreflection patterns are repeatedly formed on a front surface of the door.

15. The washing machine of claim 14, wherein the decoration part is formed as one of a lattice shape, a round shape, a quadrilateral shape, or a trilateral shape.

16. The washing machine of claim 14, wherein a metal gliding layer is formed on a front surface of the door and the decoration part is formed on the metal gliding layer.

17. The washing machine of claim 16, further comprising a transparent protection film coated on the metal gliding layer.

18. The washing machine of claim 14, wherein the reflection and irreflection patterns are formed as intaglio and relief patterns.

19. The washing machine of claim 14, wherein the intaglio and relief patterns are formed by an etching method.

20. The washing machine of claim 1, wherein the plurality of front element pieces welded to each other.

21. The washing machine of claim 20, wherein a front surface of the front element comprises a smoothly ground surface.

22. The washing machine of claim 1, wherein each of the plurality of front element pieces is formed as a circular arc encompassing a certain angle.

23. The washing machine of claim 1, wherein the adhesion element comprises a double sided tape.

* * * * *